US011168501B2

(12) United States Patent
Pavlovic

(10) Patent No.: US 11,168,501 B2
(45) Date of Patent: Nov. 9, 2021

(54) ADJUSTABLE LIFTER PLATE FOR FRAMELESS DOOR

(71) Applicant: Magna Closures Inc., Newmarket (CA)

(72) Inventor: Milos Pavlovic, Kleinburg (CA)

(73) Assignee: MAGNA CLOSURES INC., Newmarket (CA)

( * ) Notice: Subject to any disclaimer, the term of this patent is extended or adjusted under 35 U.S.C. 154(b) by 36 days.

(21) Appl. No.: 16/695,879

(22) Filed: Nov. 26, 2019

(65) Prior Publication Data

US 2020/0173212 A1 Jun. 4, 2020

Related U.S. Application Data

(60) Provisional application No. 62/772,845, filed on Nov. 29, 2018, provisional application No. 62/802,915, filed on Feb. 8, 2019.

(51) Int. Cl.
*E05F 11/48* (2006.01)
*E05D 15/16* (2006.01)

(52) U.S. Cl.
CPC ..... *E05D 15/165* (2013.01); *E05Y 2900/55* (2013.01)

(58) Field of Classification Search
CPC ..... E05F 11/382; E05F 11/385; E05F 11/483; E05F 11/486; E05F 2011/387; E05Y 2900/55; E05Y 2600/10; E05Y 2600/12; E05D 15/165
USPC ..... 49/348, 352, 349, 501, 502, 358, 375
See application file for complete search history.

(56) References Cited

U.S. PATENT DOCUMENTS 4,449,326 A 5/1984 Hori et al.
4,910,917 A 3/1990 Brauer
5,622,005 A 4/1997 Ochenski et al.
6,125,588 A * 10/2000 Schultz ..... E05F 11/385 49/358
6,131,339 A * 10/2000 Ramus ..... E05F 11/385 49/375

(Continued)

FOREIGN PATENT DOCUMENTS

CN 103270235 A 8/2013
DE 102009011120 A1 9/2010

(Continued)

OTHER PUBLICATIONS

Chinese Office Action; Appl. No. 201911203212.0; dated Feb. 10, 2021; 15 pages.

*Primary Examiner* — Chi Q Nguyen
(74) *Attorney, Agent, or Firm* — Dickinson Wright PLLC

(57) ABSTRACT

An adjustable window regulator lift plate assembly for a vehicle window includes a base and a window holder. The window holder is secured to the base via a part-in-assembly fastener that extends through an aperture in the base and into an aperture formed in an inner leg of the window holder. The window holder may receive and secure a window, and the fastener may be inserted through the window holder and into a fastener plate disposed on an outer leg of the window holder. The window holder includes a curved inner surface on the inner leg, and the base includes a curved outer surface that contacts the inner leg. The window holder may be shifted and pivoted relative to the base. The fastener may be tightened to secure the window holder relative to the base in a desired pivoted position.

22 Claims, 11 Drawing Sheets

(56) References Cited

U.S. PATENT DOCUMENTS

| | | | | |
|---|---|---|---|---|
| 6,202,351 | B1 | 3/2001 | Medebach | |
| 6,453,617 | B1 | 9/2002 | Klippert et al. | |
| 6,498,345 | B1 | 12/2002 | Weimer et al. | |
| 6,588,152 | B2 | 7/2003 | Cabbane | |
| 6,854,213 | B2 | 2/2005 | Galliani | |
| 6,966,149 | B2 | 11/2005 | Fenelon | |
| 8,096,080 | B2 | 1/2012 | Pavlovic et al. | |
| 8,453,383 | B2 * | 6/2013 | Barr | E05F 11/385 49/374 |
| 8,739,467 | B2 | 6/2014 | Reno et al. | |
| 8,881,457 | B2 | 11/2014 | Matsushita | |
| 8,966,820 | B2 | 3/2015 | Broadhead et al. | |
| 9,333,837 | B2 | 5/2016 | Broadhead et al. | |
| 2004/0107645 | A1 * | 6/2004 | Galliani | E05F 11/382 49/375 |
| 2005/0235566 | A1 | 10/2005 | Fassbender | |
| 2005/0268558 | A1 | 12/2005 | Cardine et al. | |
| 2006/0130407 | A1 * | 6/2006 | Castellon | E05F 11/385 49/375 |
| 2006/0174543 | A1 | 8/2006 | Rothe et al. | |
| 2007/0006533 | A1 | 1/2007 | Dedrich et al. | |
| 2007/0277441 | A1 | 12/2007 | Smith et al. | |
| 2008/0236049 | A1 | 10/2008 | Arimoto | |
| 2009/0007494 | A1 * | 1/2009 | Pavlovic | E05F 11/382 49/349 |
| 2010/0043297 | A1 * | 2/2010 | Barr | E05F 11/385 49/375 |
| 2011/0068609 | A1 * | 3/2011 | Saito | E05F 11/385 296/201 |
| 2012/0247020 | A1 * | 10/2012 | Trevarrow | E05F 11/385 49/348 |
| 2013/0152476 | A1 | 6/2013 | Reno et al. | |
| 2014/0041303 | A1 | 2/2014 | Broadhead et al. | |
| 2014/0086668 | A1 * | 3/2014 | Lee | E05F 11/385 403/187 |
| 2016/0208535 | A1 * | 7/2016 | Tanaka | E05F 11/385 |
| 2018/0094468 | A1 * | 4/2018 | Stewart | E05D 15/165 |

FOREIGN PATENT DOCUMENTS

| | | | |
|---|---|---|---|
| EP | 0684393 | A1 | 11/1995 |
| EP | 1816017 | A1 | 8/2007 |

* cited by examiner

ADJUSTABLE LIFTER PLATE FOR FRAMELESS DOOR

CROSS-REFERENCE TO RELATED APPLICATIONS

This patent application claims priority to U.S. Provisional Patent Application Ser. No. 62/772,845, filed Nov. 29, 2018, and U.S. Provisional Patent Application Ser. No. 62/802,915, filed Feb. 8, 2019. The entire contents of each of the above applications are incorporated herein by reference.

FIELD OF THE INVENTION

The present invention relates to adjustable window regulator lifter plates for vehicle windows, and more particularly to adjustable window regulator lifter plates for windows on a convertible.

BACKGROUND OF THE INVENTION

A door window in a vehicle is typically held by window regulator lifter plate assemblies within the door assembly. In certain types of vehicle, such as convertibles, there can be variation from vehicle to vehicle in the exact position of the roof and accordingly, there is variation in the required position of the top edge of the door window, in order to achieve a seal with the roof. Additionally, in vehicles such as convertibles, the vehicle door is typically frameless, which means that the vehicle door does not possess an upper portion with a guide track for the window. This adds to the problem because without a guide track, there will be some natural variation in the position of the top edge of the door window due simply to manufacturing tolerances in the door assembly and in any other relevant vehicle components.

To accommodate the aforementioned variation, vehicles may be manufactured with window regulator lifter plate assemblies that are adjustable so as to permit the position and orientation of the door window to be adjusted on each individual vehicle by an assembly line worker as necessary to provide the appropriate seal by the top edge of the window and the roof.

Some problems exist with some adjustable window regulator lifter plate assemblies that have been proposed. For example, some proposed window regulator lifter plate assemblies require access for adjustment from their outboard side, which is the side facing the exterior sheet metal of the vehicle door in which they are mounted. As a result, apertures are sometimes provided in the exterior sheet metal of the door to provide access. These apertures must then be covered by some suitable means, such as a polymeric plug, after use, which may detract visually from the appearance of the door, and which imposes an added complexity to the design and assembly of the vehicle.

Some other proposed window regulator lifter plate assemblies require access from the bottom edge of the vehicle door. In addition to necessitating the presence of an aperture to provide suitable access to the assembly, making an adjustment through an aperture on the bottom edge of the vehicle door can be cumbersome, Some other proposed window regulator lifter plate assemblies require a relatively large clearance in order to travel through their range of adjustability. This can sometimes be difficult to provide in the restrictive space in the interior of a door assembly.

Some other proposed window regulators include a window holding and clamping component that receives the window, which are aligned with a slider component and base component, with a screw that passes through each component, along with the window, to secure the window. Even if adjustment is possible from an inboard side, it can be difficult to align all three components when installing the screw. Additionally, the components cannot be pre-assembled and receive the window at a later time, because the screw that holds the components together cannot pass through the components until the window is installed.

SUMMARY OF THE INVENTION

It is an object of the present disclosure to provide an adjustable window regulator lifter plate assembly for a vehicle window that allows for cross-car orientation adjustment from an inboard side.

It is another object of the present disclosure to provide a lifter plate assembly that is deliverable in a pre-assembled state.

It is another object of the present disclosure to provide a lifter plate assembly that is low weight.

In one aspect, an adjustable window regulator lifter plate assembly for a vehicle window is provided. The assembly includes a base having an inboard side and an outboard side and a window holder configured to receive and hold a vehicle window, the window holder including an inner leg with an inboard surface and an outer leg with an outboard surface.

The inboard surface of the window holder faces the outboard side of the base. The inboard surface of the window holder includes a curved profile, and the outboard side of the base includes a curved profile corresponding to the curved profile of the window holder. The window holder and base are configured to shift relative to each other.

A cam is in contact the window holder and extends through the base and has an inboard end accessible and adjustable from the inboard side of the base. Adjustment of the cam shifts the window holder along the base.

In another aspect, an adjustable window regulator lifter plate assembly for a vehicle window includes: a base having an inboard side and an outboard side; a window holder configured to receive and hold a vehicle window, the window holder including an inner leg with an inboard surface and an outer leg with an outboard surface, the inner leg and outer leg monolithically formed with one another; wherein the inboard surface of the window holder and the outboard side of the base are curved, and the inboard surface of the window holder faces the outboard side of the base; wherein the window holder and the base are configured to shift relative to each other.

In one aspect, the assembly includes a cam in contact the window holder and extending through the base and having an inboard end accessible and adjustable from the inboard side of the base, wherein adjustment of the cam shifts the window holder along the base.

In one aspect, a fastener extends through an aperture of the base and into an aperture of the inner leg of the window holder.

In one aspect, the window holder includes an aperture in the outer leg and an aperture in the inner leg, wherein the apertures are coaxial and define a fastener axis configured to receive a fastener therethrough.

In one aspect, the base includes a slotted aperture aligned with the fastener axis and configured to allow the fastener to shift along the base when the fastener is received in the window holder.

In one aspect, the assembly includes a fastener plate attached to the outer leg of the window holder on the outboard surface thereof.

In one aspect, the fastener plate includes an aperture configured to receive a fastener, wherein the aperture defines a fastener axis, and the window holder includes apertures in the inner leg and outer leg aligned with the fastener axis.

In one aspect, the assembly includes a fastener extending through a slot defined in the base and wherein the fastener extends into the aperture of the inner leg of the window holder.

In one aspect, the fastener is axially aligned with the apertures in the outer leg of the window holder and the fastener plate in a first position, and the fastener is secured in the aperture of the inner leg in a first state of the assembly.

In one aspect, the fastener is disposed further outward relative to the first state, and the fastener extends through the outer leg of the window holder and is secured in the aperture of the fastener plate in a second state of the assembly.

In one aspect, the fastener does not extend into the apertures of the outer leg and the fastener plate in the first state of the assembly.

In one aspect, the second state includes an upper state and a lower state, wherein the window holder is pivoted upward relative to the base in the upper state and is pivoted downward relative to the base in the lower state.

In one aspect, the fastener is accessible and adjustable on the inboard side of the base.

In another aspect, an adjustable window regulator lifter plate assembly for a vehicle window is provided. The assembly includes a window holder having an inner leg and an outer leg and a base having an outer side facing the inner leg of the window holder and an inner side. A fastener extends through an aperture of the base and into an aperture of the outer leg of the window holder in a first assembly state.

The outer leg of the window holder includes a curved inner surface, and the outer side of the base includes curved outer surface corresponding to the curved inner surface of the window holder. The window holder is shiftable relative to the base in the first assembly state.

The assembly includes a second assembly state in which the fastener is inserted outward relative to the first assembly state and extends into an aperture of the outer leg of the window holder. The window holder is fixed relative to the base in the second assembly state.

In one aspect, the aperture of the inner leg is threaded, and the fastener is in threaded engagement with the inner leg in the first assembly state.

In one aspect, the assembly includes a fastener plate secured to an outer surface of the outer leg of the window holder, the fastener plate including a threaded aperture, wherein the fastener is in threaded engagement with the threaded aperture of the fastener plate in the second assembly state.

In one aspect, the second assembly state includes an upper state and a lower state, wherein in the upper state the fastener is disposed at an upper end of the aperture of the base and in the lower state the fastener is disposed at a lower end of the aperture of the base.

In one aspect, an upper end of the window holder is disposed outwardly in the upper state and inwardly in the lower state.

In yet another aspect, a method for adjusting a window regulator lifter plate assembly for a vehicle window is provided. The method includes providing a lifter plate assembly in a first assembly state, the lifter plate assembly having an inner side and an outer side and comprising a window holder, a base, and a fastener, wherein the fastener extends through an aperture in the base and into an aperture formed in an inner leg of the window holder.

The method further includes accessing an inner end of a cam on the inner side of the assembly, wherein the cam extends through the base and is in contact with the window holder.

The method includes rotating the cam and, in response thereto, shifting the window holder relative to the base. The method further includes inserting the fastener through an aperture formed in an outer leg of the window holder and, in response thereto, securing the window holder relative to the base in a second assembly state.

The inner leg of the window holder has a curved inner surface and the base has a corresponding curved outer surface, such that the window holder slides along the base and pivots in response to rotation of the cam.

In one aspect, the assembly includes a fastener plate secured to the outer leg, and the fastener plate includes a threaded aperture and receives the fastener in the second assembly state.

In one aspect, the second assembly state includes an upper state and a lower state, wherein in the upper state, the fastener is disposed at an upper end of the aperture in the base and in the lower state the fastener is disposed at a lower end of the aperture in the base.

In one aspect, wherein the inner and outer leg of the window holder are monolithically formed.

In another aspect, an adjustable window regulator lifter plate assembly for a vehicle window includes: a base having an inboard side and an outboard side; and a window holder configured to receive and hold a vehicle window, the window holder including an inner leg with an inboard surface and an outer leg with an outboard surface, the inner leg and outer leg monolithically formed with one another; wherein the inboard surface of the window holder faces the outboard side of the base, and wherein the window holder and base are configured to shift relative to each other.

In one aspect, the assembly includes a fastener plate attached to the outer leg of the window holder on the outboard surface thereof.

In one aspect, the fastener plate is made of metal, and the window holder and the base are made of plastic.

BRIEF DESCRIPTION OF THE DRAWINGS

The present invention will now be described by way of example only with reference to the attached drawings, in which.

DETAILED DESCRIPTION

Figure 1:
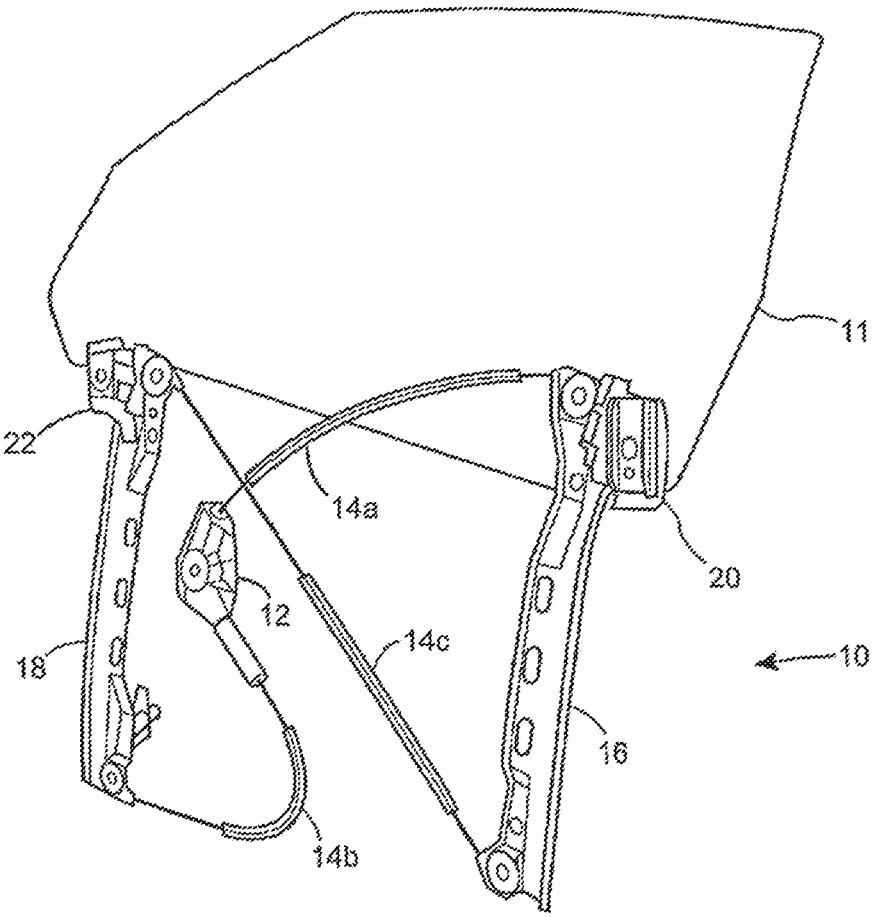
FIG. 1 is a perspective view of a window regulator assembly with a vehicle window, in accordance with an aspect of the present invention.

Reference is made to FIG. 1, which shows a window regulator assembly 10 for moving a vehicle window 11 up and down, in accordance with an embodiment of the present invention. The window regulator assembly 10 may include a drive motor 12, a set of three drive cables 14*a*, 14*b* and 14*c*, a first rail 16, a second rail 18, a first window regulator lifter plate assembly 20 and a second window regulator lifter plate assembly 22.

The drive motor 12 is mountable to a carrier (not shown) or to some other suitable element of a door assembly. The drive motor 12 drives vertical movement of the first and second window regulator lifter plate assemblies 20 and 22 on the rails 16 and 18 respectively by means of the drive cables 14*a*, 14*b* and 14*c*.

The first and second window regulator lifter plate assemblies 20 and 22 are movably connected to the rails 16 and 18 respectively for vertical movement thereon along a path. Referring to FIGS. 2*a*-2*d*, the window regulator lifter plate assembly 20 includes a base 24, a window holder 26, a cable holder 27, a window fastener 28, a fastener plate 29, a cross-car orientation adjustment mechanism 30 (FIG. 2*b*), and a height adjustment mechanism 32.

Figure 2A:
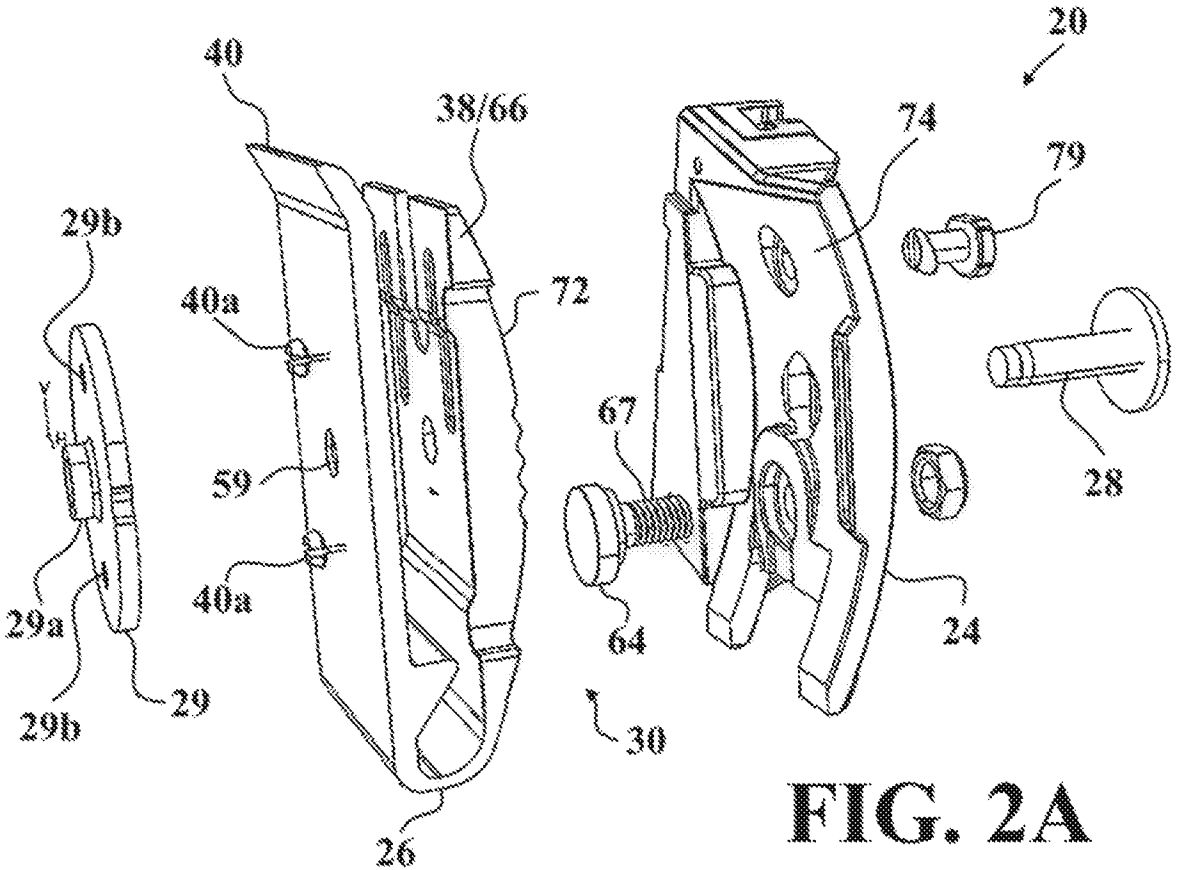
FIG. 2*a* is a magnified exploded perspective view of a window regulator lifter plate assembly shown in FIG. 1.
Figure 2B:
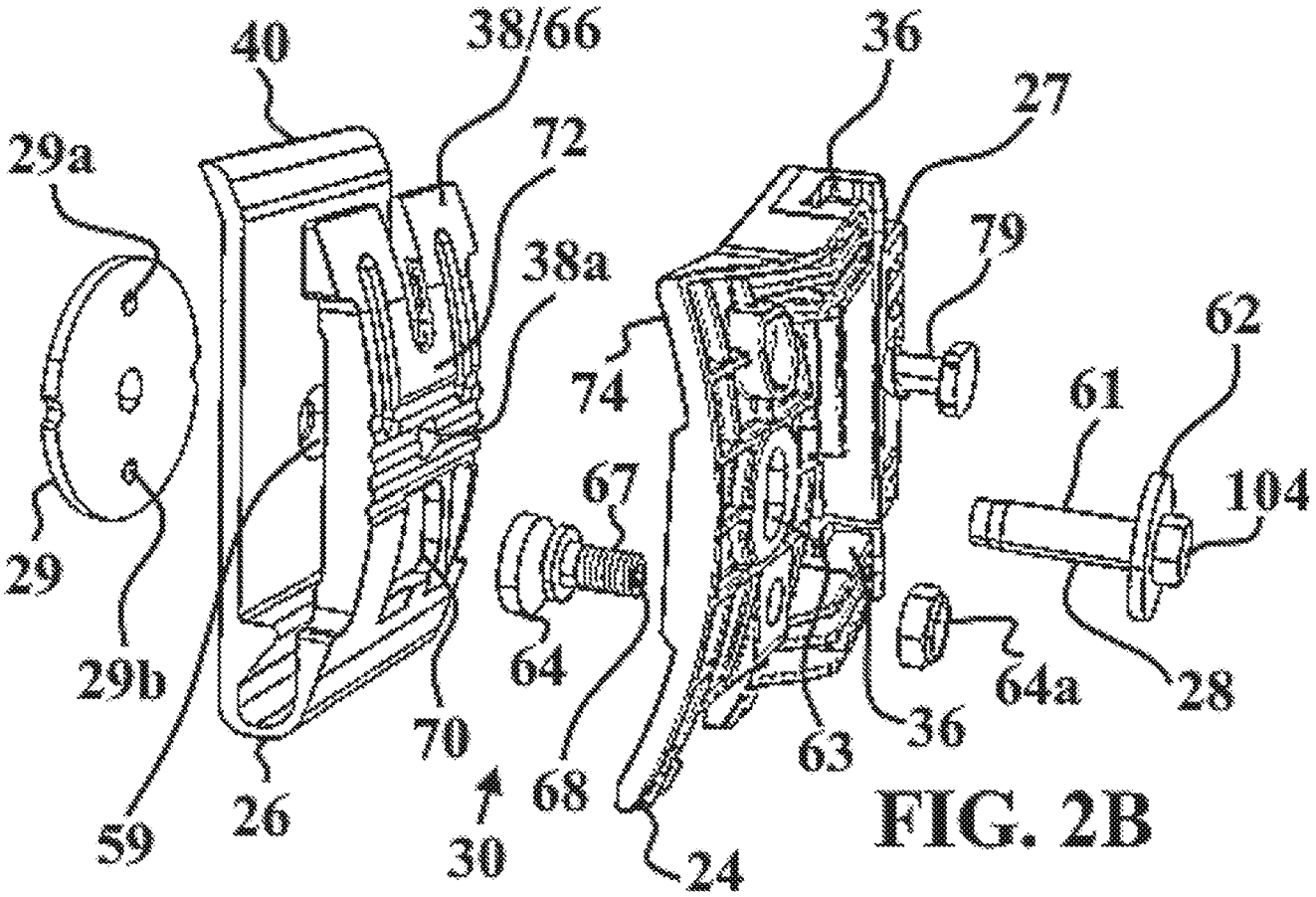
FIG. 2*b* is another magnified exploded perspective of the window regulator lifter plate assembly shown in FIG. 2*a;*

Referring to FIG. 2*b*, the base 24 includes upper and lower rail guides 36 for mounting to the rail 16 (FIG. 1) while permitting sliding movement therewith. In this way, the base 24 is configured for movable association with the rail 16 (FIG. 1).

The configuration of the rail 16 (FIG. 1) and the rail guides 36 (FIG. 2*b*) may be any suitable configuration. For example, the engagement portion of the rail 16 (i.e. the portion of the rail 16 that is engaged by the rail guides 36) may be generally L-shaped in cross section, and the rail guides 36 (FIG. 2*b*) may have a generally L-shaped slot to accommodate the engagement portion of the rail 16. This substantially prevents the inadvertent disengagement of the base 24 from the rail 16.

The base 24 may be made from any suitable material or combination of materials, such as, for example, a combination of a metal, such as Aluminum, with a polymeric material for selected portions, such as the rail guides 36.

Figure 4C:
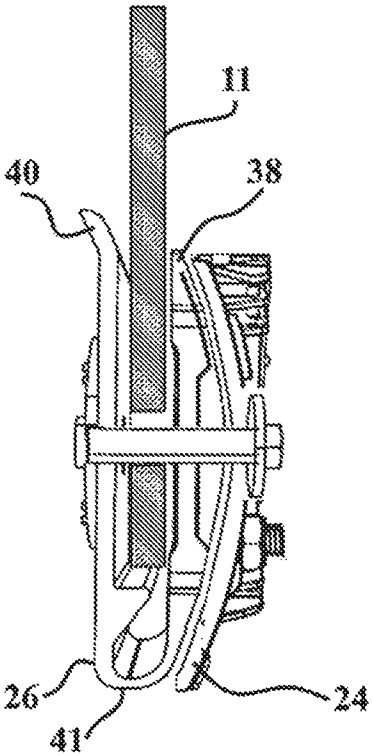
FIG. 4*c* is a magnified side view of the lifter plate assembly illustrating the window fastener in an installed position and retaining the window glass component.
Figure 4B:
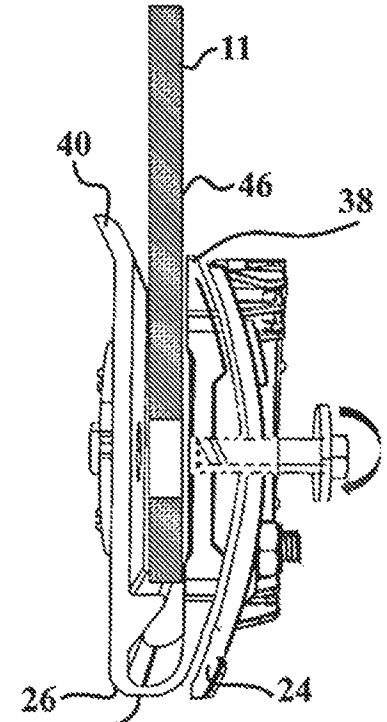
FIG. 4*b* is a magnified side view of the lifter plate assembly illustrating the window glass component in an inserted position within the slider.
Figure 4A:
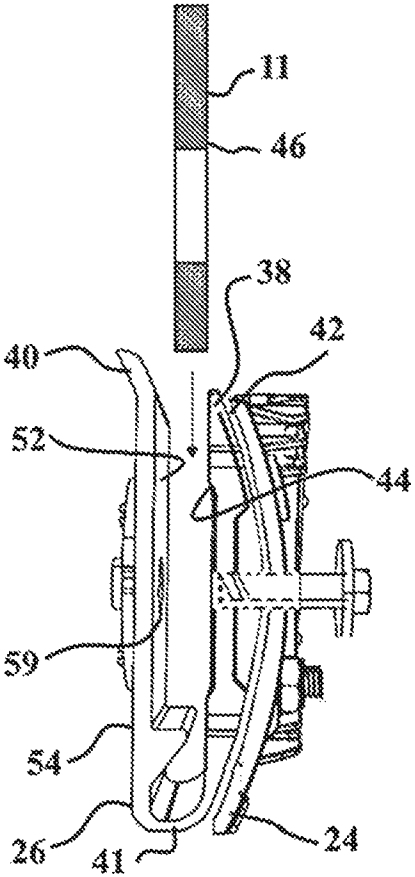
FIG. 4*a* is a magnified side view of the lifter plate assembly illustrating the window glass component being inserted into the slider.

Referring to FIGS. 4*a*-4*c*, the window holder 26 is configured to receive and hold the vehicle window 11. In the embodiment shown, the window holder 26 is generally U-shaped and includes an inboard leg 38, an outboard leg 40, and a bottom wall 41. The outboard leg 40 includes a lip 99 extending towards inboard leg 38 for supporting and/or stopping window 11 for aligning aperture 101 provided in window 11 with aperture 59 and aperture 38*a*. The inboard leg 38 has an inboard face shown at 42 and an outboard face shown at 44. The outboard face 44 slidingly engages the base 24 such that the window holder 26 may be adjustable via the cross-car orientation adjustment mechanism 30 and is preferably low-friction. The inboard leg 38 engages an inboard face of the vehicle window 11, shown at 46. The window 11 includes an aperture 50 that can receive the window fastener 28 therethrough.

The inboard leg 38 may include a suitable polymeric material on its inboard and outboard faces 42 and 44. The presence of the suitable polymeric material provides low friction engagement between the inboard face 42 and the base 24 for allowing adjustment via the cross-car-orientation adjustment mechanism 30. Additionally, the suitable polymeric material reduces the likelihood of damage to the vehicle window 11 from engagement with the inboard leg 38.

The outboard leg 40 has an inboard face shown at 52 and an outboard face shown at 54. The outboard leg 40 may include a suitable polymeric material on its inboard face 52 for engagement with the outboard face of the vehicle window 11, shown at 56. The outboard leg 40 may further include an aperture 59 therethrough, for receiving the window fastener 28, as described in further detail below for fixing the position of the window holder 26 relative to the base 24.

Referring to FIG. 2*b*, the window fastener 28 may include a bolt 61 and a washer 62 that may be integral with or separate from the bolt 61. The bolt 61 passes through an aperture 63 in the base 24, through an aperture 38*a* in the inboard leg 38 of the window holder 26, and through the aperture 59 in the outboard leg 40 of the window holder 26. The bolt 61 may then be threaded into the fastener plate 29.

The fastener plate 29 may be in the form of a disc or other generally flat shape. The fastener plate 29 includes a threaded aperture 29*a*, which may also include a post or other projecting structure that extends outwardly from the outboard surface of the fastener plate 29. The fastener plate may also include at least one opening 29*b* extending through the plate for receiving a snap fit connector 40*b* disposed on the outer face 54 of the outer leg 40 of the window holder 26. Accordingly, the fastener plate 29 may be secured to the outer leg 40 of the window holder 26 via a snap-fit, such that the threaded aperture 29*a* is aligned with the aperture 59 of the outer leg 40.

The window 11 may be secured in the window holder 26, with the fastener plate 29 secured to the window holder 26, and the window holder 26 secured to the base 24. The window holder 26 is secured to the base 24 via the window fastener 28. When securing the vehicle window 11 and the window holder 26 to the base 24, the window fastener 28 may be torqued to 8 Newton-meters.

The window holder 26 operates as a combination of a slider and a glass clamp, which is an improvement on prior solutions in which a separate glass-clamping component was used along with a separate slider component. In prior solutions, the glass clamp component would include a threaded aperture that received a window fastener. The glass clamp would include metal reinforcement to provide the threaded support of the aperture to receive the fastener. The slider component would include a vertical slot, because the slider would slide relative to both the glass clamp and the base. However, the fastener would be unable to hold the glass clamp and slider in place prior to installing the window, because threading in the fastener would block the introduction of the window into the clamp. Thus, the glass clamp and slider would need to be supported by additional structure of the base.

Figure 3A:
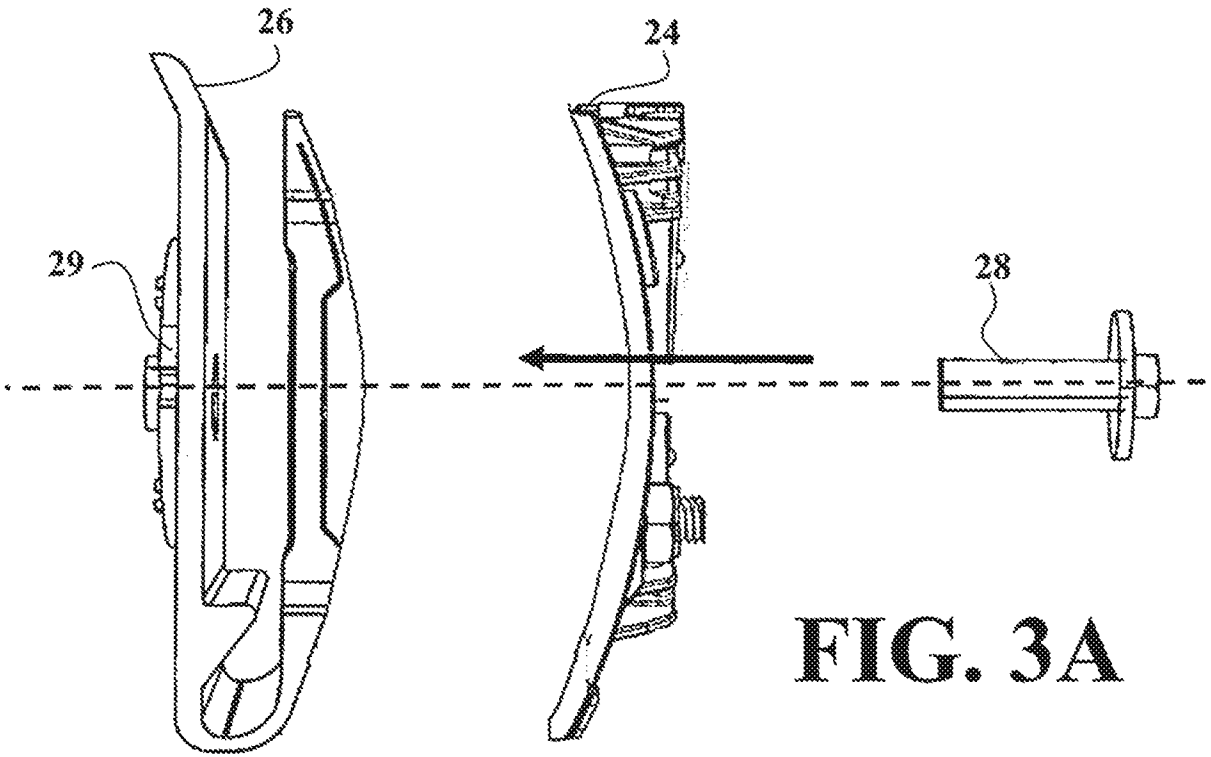
FIG. 3*a* is a magnified exploded side view of a slider, a base, and a window fastener, with a fastener plate attached to the slider.
Figure 3B:
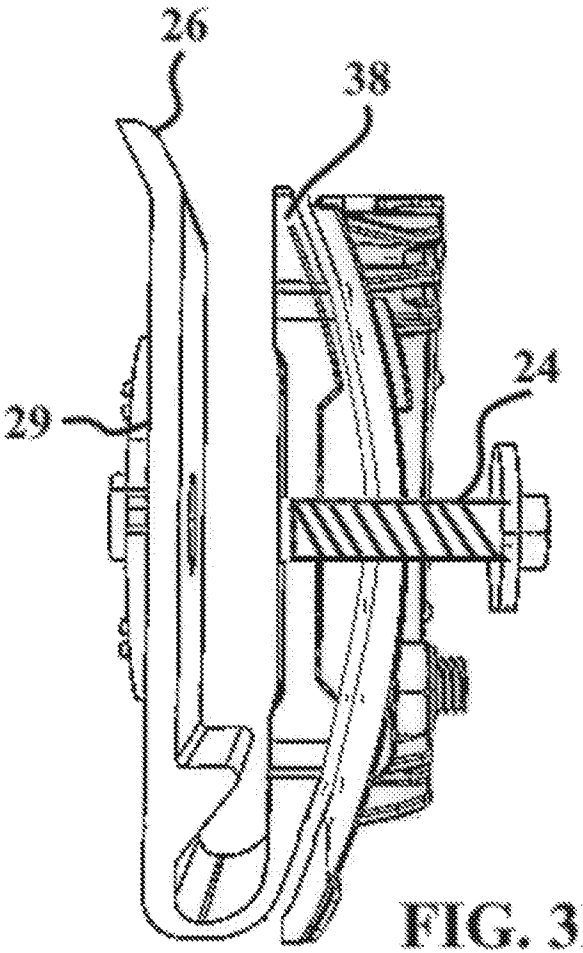
FIG. 3*b* is a magnified side view of the components of FIG. 3*a* in an assembled state.

In the present approach, the window holder 26 may be preassembled prior to introducing the window 11, such that the window holder 26, fastener plate 29, base 24, and fastener 28 may be assembled and secured to each other and shipped as a unit in an assembled state. FIGS. 3*a* and 3*b* illustrate these components in a non-assembled state and an assembled state.

In FIG. 3*a*, the window holder 26, the base 24, and the fastener 28 are aligned along an axis of insertion of the fastener 28. The fastener plate 29 is secured to the window holder 26 via the snap-fit described above. To secure the window holder 26 to the base 24, the fastener 28 may be inserted through the base 24 and into engagement with the inboard leg 38 of the window holder 26. As shown in FIG. 3*b*, the fastener 28 is engaged with the inboard leg 38 and passes through the base 24. Accordingly, the fastener 28 may be shipped as a part-in-assembly with the base 24 and the window holder 26 secured to each other via the fastener 28. The aperture 38*a* of the inboard leg 38 may be threaded to retain the fastener 28. The fastener 28, being threaded into the inboard leg 38, is aligned with the fastener plate 29 that is secured to the outboard leg 40. To secure the window 11, the fastener 28 can simply be advanced further through the window holder 26 and into the fastener plate 29. The window holder 26 is adjustable relative to the base 24, so the base 24 may remain somewhat loose relative to the window holder 26 in the state shown in FIG. 3*b*.

By using the window holder 26 as both the window clamp and the adjustable slider relative to the base 24, the window holder 26 may be made of a relatively lightweight material, such as a polymer or plastic material, and can be made without metal reinforcement, because the window holder 26 is not the final component that the fastener 28 will engage. Rather, the fastener plate 29 will ultimately receive the fastener 28 and the tension on the threads. Thus, the fastener plate 29, which is smaller than the window holder 26, may be made from metal. The fastener plate 29 may be a stamped metal part. The base 24 may also be a metal part, and may be die-cast. By using the window holder 26 as the clamp and slider, and by not threading the fastener 28 into the window holder 26 in the final installation state, substantial weight savings may be realized while providing a similarly secure and robust assembly when compared to prior assemblies having metal reinforced clamps and a separate plastic sliders.

FIG. 4*a*-4*c* illustrate the assembly of the window holder 26, the base 24, and the fastener 28 along with the installation stages of the window 11. In FIG. 4*a*, the window holder 26 and fastener 28 are in position to receive the window 11, and the window 11 may be inserted downward into the window holder 26. In FIG. 4*b*, the window 11 has been received in the window holder 26, and the fastener 28 may be advanced through the window 11 and toward the fastener plate 29 being held on the window holder 26. To advance the fastener 28, the fastener 28 may be torqued, advancing the fastener through the threaded aperture of the inboard leg 38. In FIG. 4*c*, the fastener 28 has been advanced through the window 11 and is engaged with the fastener plate 29. The fastener 28 may be torqued to a lower level that is sufficient to secure the window holder 26 against the base 24, which also permitting the window holder 26 to slide relative to the base 24, as further described below. If necessary, the fastener 28 may be reversed slightly to allow the window holder 26 to more easily slide relative to the base 24.

Referring to FIGS. 2*b* and 5*a*-5*c*, the cross-car orientation adjustment mechanism 30 is used to adjust the cross-car orientation of the window holder 26, thereby adjusting the cross-car position of the top edge of the vehicle window 11. The cross-car orientation adjustment mechanism 30 includes a cross-car orientation adjustment cam 64 and the inboard leg 38 operates as a cross-car orientation adjustment cam follower 66. Thus, the inboard leg 38 and the cam follower 66 may be the same component. The cross-car orientation adjustment cam 64 includes a shaft 67 along its axis of rotation. The shaft 67 includes at its end a tool-receiving aperture 68 for receiving a tool (not shown). The tool-receiving aperture 68 may be, for example, an Allen key aperture, and the tool may be, for example, an Allen key.

The cross-car orientation adjustment cam 64 engages a cam following surface 70 (FIG. 2*b*) on the cross-car orientation adjustment cam follower 66. As the cross-car orientation adjustment cam 64 rotates, the cross-car orientation adjustment cam follower 66 is urged upwards or downwards relative to the base 24.

Figure 5C:
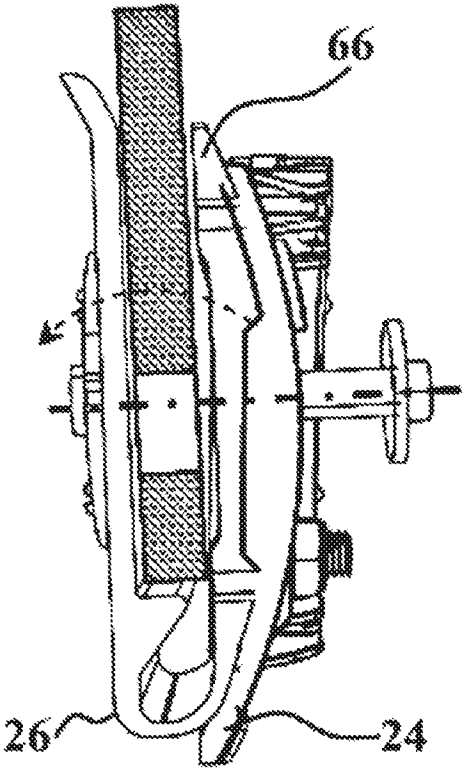
FIG. 5*c* is a magnified elevation view of the window regulator lifter plate assembly in a third cross-car orientation.
Figure 5B:
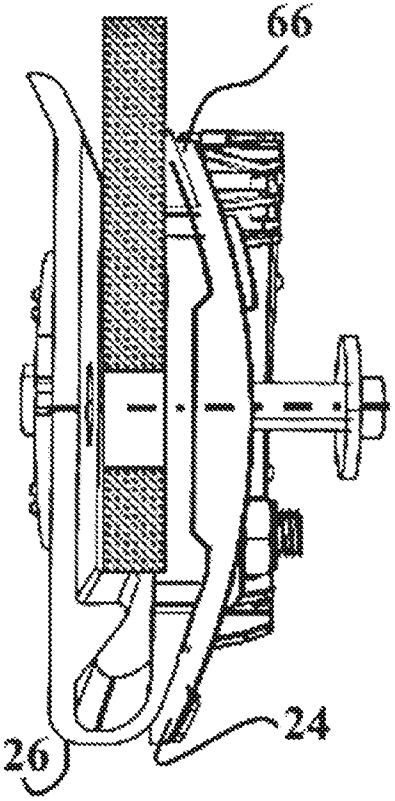
FIG. 5*b* is a magnified elevation view of the window regulator lifter plate assembly in a second cross-car orientation.
Figure 5A:
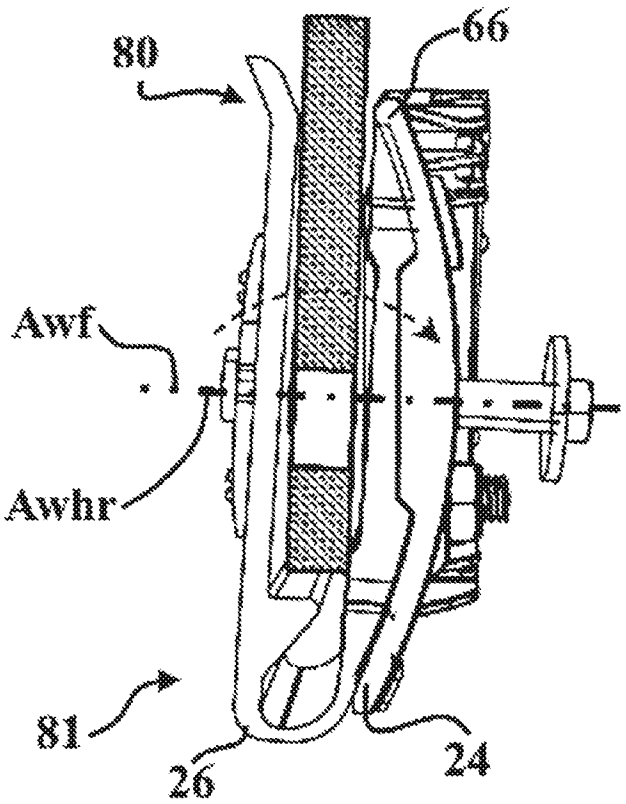
FIG. 5*a* is a magnified elevation view of the window regulator lifter plate assembly in a first cross-car orientation.

Referring to FIGS. 2*a* and 2*b*, the cross-car orientation adjustment cam follower 66 includes a base engagement surface 72 that is cylindrically arcuate. The base engagement surface is also the outboard face 42 of the outboard leg 38. The base engagement surface 72 mates with and slidingly engages a cam follower engagement surface 74 on the base 24. The term 'cylindrically arcuate', as applied to the base engagement surface 72, means a surface that has the shape of a part cylinder. As the cross-car orientation adjustment cam follower 66 is urged upwards or downwards relative to the base 24, as shown in FIGS. 5*c* and 5*a* respectively, the engagement of the cylindrically arcuate base engagement surface 72 with the cam follower engagement surface 74 causes a rotational change in the orientation of the cam follower 66. The different rotational positions of the window holder 26 are shown in FIGS. 5*a*-5*c*, which result from the cam follower 66/inboard leg 38 sliding along the base 24 in response to adjustment of the cam 64.

In addition to the cam 64, a cam nut 64*a* may be used to secure the cam 64 in a desired position. The cam nut 64*a* may thread onto the end of the cam 64 and may be advanced into engagement with the inboard surface of the base 24, thereby pulling the cam 64 against the base 24 and fixing the cam 64 in place, which thereby fixes the adjusted window holder 26 in place and fixes the cross-car orientation of the window 11 being held by the window holder 26.

The cross-car orientation adjustment cam follower 66, being an integral part of the window holder 26, thereby causes rotation of the window holder 26. Any rotational change in the orientation of the cross-car orientation adjustment cam follower 66 causes a corresponding rotational change in the orientation of the window holder 26. Accordingly, an assembly line worker (not shown) does not need to hold the window holder 26 and the window 11 in place during adjustment of the cam follower 66. Rather, the window 11 may simply be received and supported in the window holder 26. Thus, the window holder 26 can be maintained at a known general reference height in relation to the base 24 throughout the adjustment process.

The cross-car orientation adjustment cam 64 may be made from any suitable material, such as, for example, a metal, such as Aluminum. The cross-car orientation adjustment cam follower 66, being part of the window holder 26 and being the inboard leg 38 thereof, can be made of the same material as the other portions of the window holder 26.

It will be noted that the tool-receiving aperture 68 of the cam 64 is accessible from the inboard side of the base 24. As a result, adjustment of the vehicle window 11 using the cross-car orientation adjustment mechanism 30 can be carried out relatively easily from the inboard side of the vehicle door (not shown) during vehicle assembly, and without requiring that the window holder 26 be supported by the assembly line worker.

Figure 2C:
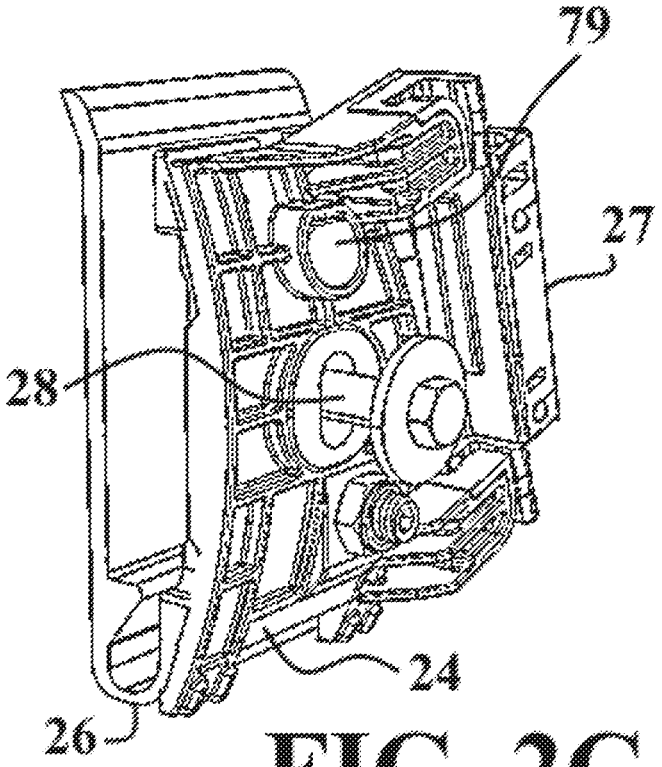
FIG. 2*c* is a magnified perspective view of the window regulator lifter plate assembly shown in FIGS. 2*a* and 2*b* in an assembled state prior to installation of a window glass component.

Referring to FIGS. 2*b* and 2*c*, a retainer pin 79, having a head at one end and a split head at the other end, may extend through the base 24 and through a slotted aperture in the cross-car orientation adjustment cam follower 66 to retain the window 11 within the window holder 26 after adjusting the cross-car orientation adjustment cam follower 66. The retainer pin 79 may be used as an additional fixing mechanism to hold the window 11 in place, along with the window fastener 28. For example, when the window 11 and the window holder 26 have been adjusted relative to the base 24, and the window fastener 28 is advanced to secure the window holder against the base 24, the retainer pin 79 may be pressed through the base 24 and come into contact with the inboard leg 38, thereby pressing the inboard leg 38 against the window 11, providing additional securement.

The retainer pin 79 may also be advanced through the base 24 prior to fully advancing the window fastener 28. For example, the window fastener 28 may be advanced a sufficient degree to hold the window holder 26 to the base 24 but still allowing the window holder 26 to be adjusted by the cam 64. When the window holder 26 is adjusted via the cam 64, the fastener 28 will pivot along with the window holder 26 and the head of the fastener 28 will slide along the surface of the base 24. Upon being adjusted to the desired orientation, the retainer pin 79 may be inserted through the base 24 and into engagement with the inboard leg 38, adding tension to the fastener 28 and holding the window holder 26 in place relative to the base. The fastener 28 may then be torqued further to more fully secure the window holder 26 relative to the base 24.

The window holder 26 has a top 80 and a bottom 81. It will be noted that the center of rotation of the window holder 26 during a cross-car orientation adjustment is a window holder rotation axis Awhr (shown in FIG. 5*a*) that is vertically spaced from the top 80 of the window holder 26, towards the bottom 81. In the particular embodiment shown in FIGS. 5*a*, 5*b* and 5*c*, the window holder rotation axis Awhr is vertically midway between the top 80 and bottom 81. As a result of the window holder rotation axis Awhr being spaced from the top 80 towards the bottom 81, the window holder 26 goes through a relatively reduced overall angular change to achieve a given change in cross-car position for the top edge of the vehicle window 11, as compared to some prior art lifter plate assemblies that rotate the window holder about an axis proximate the top edge of the window holder. Thus, the overall operating clearance required for movement of the window holder 26 is reduced, which in turn facilitates its use in the restricted available space in some vehicle door assemblies.

Additionally, it will be noted that the axis of rotation Awhr of the window holder 26 intersects the axis Awf of the bolt 61 (FIG. 5*a*). This permits the bolt 61 to remain in a relatively tightened condition during a cross-car orientation adjustment. For example, in one embodiment, when effecting a cross-car window orientation adjustment, the torque on the bolt 61 is preferably at a torque of about 6 Newton-meters or less. The torque may thus be sufficiently high that the vehicle window 11 is held relatively tightly in the window holder 26. This is advantageous because the position of the vehicle window 11 does not significantly change after the cross-car orientation adjustment is carried out and the bolt 61 is tightened up to 8 Newton-meters of torque. By contrast, in some adjustment mechanisms of the prior art, the window fastener is loosened to the point where the vehicle window is only held loosely in the window holder (i.e. to the point where there is clearance between the window and the two walls of the window holder). As a result, the position of the window is susceptible to change when the window fastener is retightened. It will be understood that the window holder rotation axis Awhr need not precisely intersect the window fastener axis Awf. The advantage of the window fastener remaining relatively tight during a cross-car orientation adjustment can be achieved even if the window holder rotation axis Awhr generally intersects (i.e. is proximate to) the window fastener axis Awf.

Figure 2D:
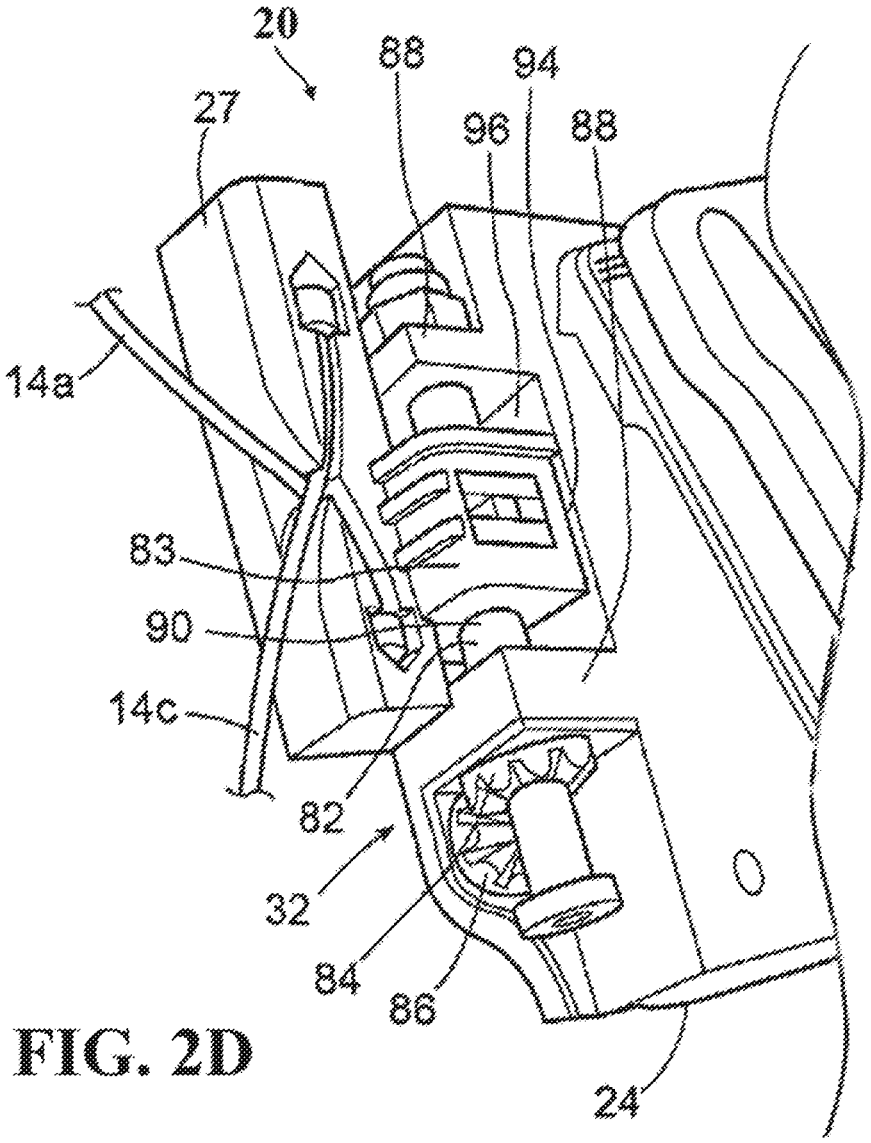
FIG. 2*d* is a partial perspective view of the window regulator lifter plate assembly illustrating a cable holder.

Referring to FIG. 2*d*, the cable holder 27 is configured to hold the ends of the cables 14*a* and 14*c* (FIG. 2*d*). The height adjustment mechanism 32 is used to adjust the height of the cable holder 27 and the base 24 (and window holder 26) relative to each other. The cable holder 27 may be made from any suitable material, such as a suitable polymeric material with a backing made from a metal, such as Aluminum. The height adjustment mechanism 32 includes a threaded rod 82, a traveler 83, a first gear 84 and a second gear 86. The threaded rod 82 is rotatably supported in two spaced supports 88 on the base 24. The threaded rod 82 includes a threaded portion 90 between the supports 88. The threaded rod 82 may be made from a suitable material, such as a corrosion resistant steel. The traveler 83 includes an internally threaded portion 92 (FIG. 4) that engages the threaded portion 90 on the threaded rod 82. The traveler 83 further includes a rotation-prevention surface 94 that engages a corresponding surface 96 on the base 24 to prevent the rotation of the traveler 83 when the threaded rod 82 is itself rotated. Thus, when the threaded rod 82 is rotated, the traveler 83 travels along the threaded portion 90, thereby adjusting the vertical positions of the traveler 83 and the base 24 relative to each other.

Figure 6:
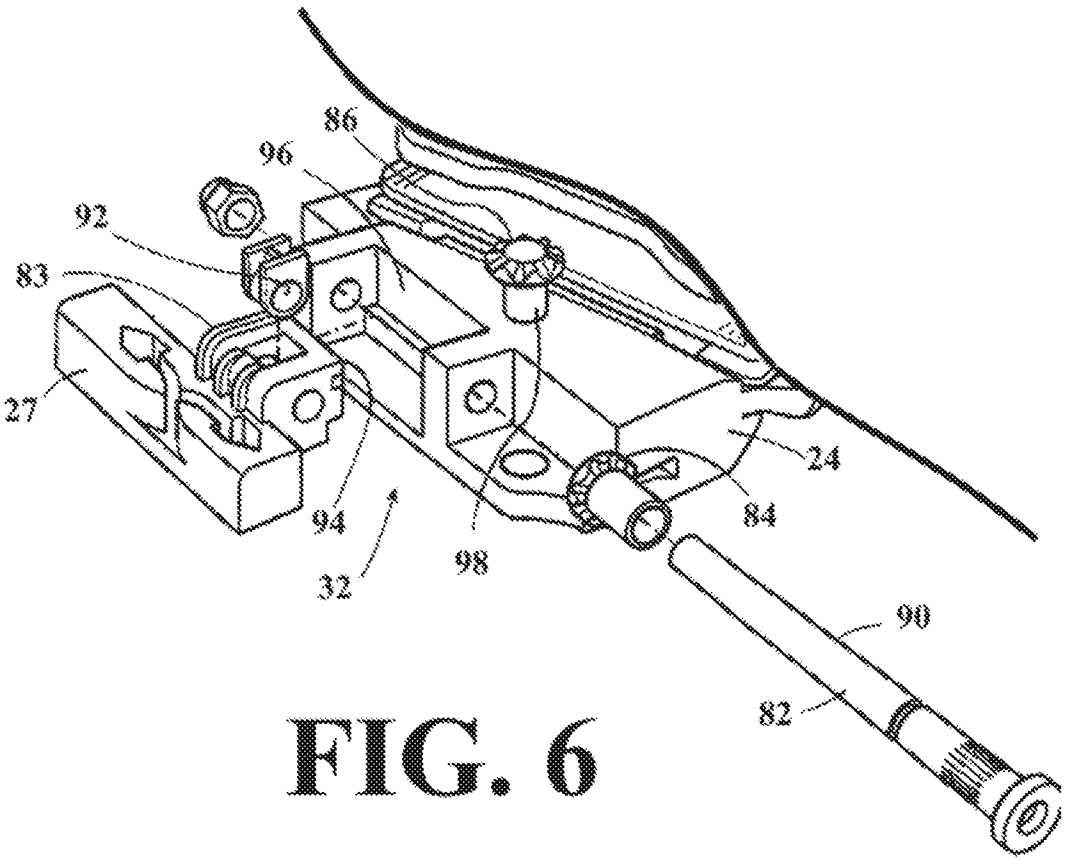
FIG. 6 is a magnified, exploded, perspective view of the window regulator lifter plate assembly.

In the embodiment shown in FIG. 6, the traveler 83 is itself connected to the cable holder 27, which, in use, holds the ends of the cables 14*a* and 14*c*, thereby keeping the cable holder 27 in a fixed position during a height adjustment, Thus, the traveler 83 actually remains stationary during a height adjustment while the base 24 moves up or down.

The traveler 83 may be made from any suitable material or combination of materials, such as a combination of metal and polymeric materials.

Figure 7:
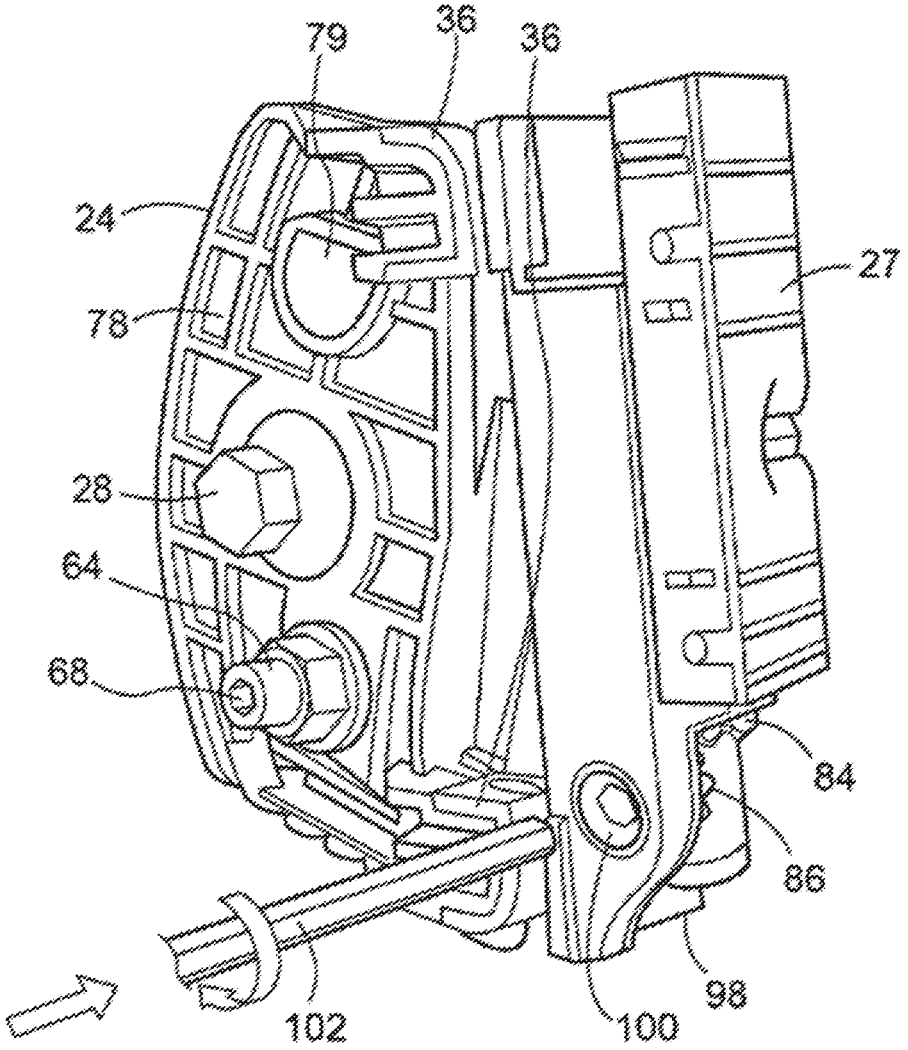
FIG. 7 is a perspective view of the window regulator lifter plate assembly shown in FIG. 2*a*, illustrating height adjustment.

The first gear 84 may be provided on an end of the threaded rod 82, and may be a bevel gear. The second gear 86 meshes with the first gear 84 and may also be a bevel gear, as shown in FIG. 2*a*. The second gear 86 includes a shaft 98 (FIG. 6) that passes through an aperture to the inboard side 78 (FIG. 7) of the base 24. The shaft 98 includes at its end a tool-receiving member 100 (FIG. 7), which is accessible from the inboard side 78 of the base 24. The tool-receiving member 100 receives a tool 102 which can be used to rotate the second bevel gear 86, which in turn rotates the first gear 84, which in turn causes movement of the traveler 83 on the threaded rod 82.

The tool-receiving member 100 may be configured to receive any suitable kind of tool. For example, the tool-receiving member 100 may be an Allen key aperture configured to receive an Allen key. Advantageously, the tool-receiving member 100 and the tool-receiving aperture 68 (for the cam 64) may be configured to receive the same tool, such as, for example, the same size of Allen key. This would permit the assembly line worker to make both the height adjustment and the cross-car orientation adjustment on the vehicle window 11 using the same tool, thereby saving time.

It will be noted that the window fastener 28 does not require loosening at all to effect a height adjustment of the vehicle window 11. The window fastener 28 may remain fully torqued to fix the window holder 26 and the window 11 in place relative to the base 24 to set the cross-car orientation, and the height of the base 24 may be adjusted, which will raise/lower the window holder 26 and the window 11 secured therein.

Fore and aft adjustability may be provided via the aperture of the window 11. For example, prior to fully securing the window 11 within the window holder 26, the window 11 may be slid fore and aft relative to the window holder 26. With the window 11 in the desired fore and aft position, the fastener 28 may be advanced to secure the window 11 within the window holder 26. The window aperture may be slotted for this purpose, allowing fore and aft movement relative to the fastener 28 passing through the window 11. In an alternative approach, the aperture 63 in the base 24 may be slotted in the fore and aft direction, allowing the fastener 28 and the window holder 26 to slide in the fore and aft direction relative to the base 24.

The bolt 61 has a head 104 that is a tool-receiving member. The head 104 may be any suitable kind of head, such as a hex-head, as shown in FIG. 2*b*. The head 104 is exposed on the inboard side 78 of the base 24, and is therefore accessible by a suitable tool from the inboard side 78 of the base 24. Thus, all of the adjustments including the cross-car orientation adjustment, the height adjustment and the fore/aft adjustment can be made from the inboard side 78 of the base 24. Additionally, securing of the vehicle window 11 with the window fastener 28 is carried out from the inboard side 78 of the base 24.

Referring to FIG. 1, the window regulator lifter plate assembly 22 may be similar to the window regulator lifter plate assembly 20, but may be a mirror image thereof. Similarly, the rail 18 may be similar to the rail 16, but may be a mirror image thereof.

It has been described above that the window regulator 10 and the vehicle window 11 are mounted in a vehicle door (not shown). It will be understood that the window regulator 10 could be used with a vehicle window that is not door-mounted. For example, in convertibles, it is known to provide rear side windows aft of the vehicle door windows. These rear side windows retract into the body of the vehicle and not into the doors.

While the above description constitutes a plurality of embodiments of the present invention, it will be appreciated that the present invention is susceptible to further modification and change without departing from the fair meaning of the accompanying claims.

What is claimed is:

1. An adjustable window regulator lifter plate assembly for a vehicle window, the adjustable window regulator lifter plate assembly comprising:

a base having an inboard side and an outboard side;

a window holder configured to receive and hold a vehicle window, the window holder including an inner leg with an inboard surface and an outer leg with an outboard surface, the inner leg and outer leg being monolithically formed with one another;

wherein the inboard surface of the window holder and the outboard side of the base are curved, and the inboard surface of the window holder faces the outboard side of the base, and wherein the window holder and base are configured to shift relative to each other.

2. The assembly of claim 1 further comprising a cam in contact with the window holder and extending through the base and having an inboard end accessible and adjustable from the inboard side of the base;

wherein adjustment of the cam shifts the window holder along the base.

3. The assembly of claim 1 further comprising a fastener extending through a base aperture of the base and into an inner leg aperture of the inner leg of the window holder.

4. The assembly of claim 1, wherein the window holder includes an outer leg aperture in the outer leg and an inner leg aperture in the inner leg, wherein the outer leg and inner leg apertures are coaxial and define a fastener axis configured to receive a fastener therethrough, wherein the base includes a slotted aperture aligned with the fastener axis and configured to allow the fastener to shift along the base when the fastener is received in the window holder.

5. The assembly of claim 1 further comprising a fastener plate attached to the outer leg of the window holder on the outboard surface thereof.

6. The assembly of claim 5, wherein the fastener plate is made of metal, and the window holder and the base are made of plastic.

7. The assembly of claim 5, wherein the fastener plate includes a fastener plate aperture configured to receive a fastener, wherein the fastener plate aperture defines a fastener axis, and the window holder includes inner leg and outer leg apertures in the inner leg and outer leg, respectively, aligned with the fastener axis.

8. The assembly of claim 7, further comprising a fastener extending through a slot defined in the base and wherein the fastener extends into the inner leg aperture of the inner leg of the window holder, wherein the fastener is axially aligned with the outer leg aperture in the outer leg of the window holder and fastener plate aperture of the fastener plate in a first position, and the fastener is secured in the inner leg aperture of the inner leg in a first state of the assembly.

9. The assembly of claim 8, wherein the fastener is disposed further outward relative to the first state, and the fastener extends through the outer leg of the window holder and is secured in the fastener plate aperture of the fastener plate in a second state of the assembly.

10. The assembly of claim 9, wherein the second state includes an upper state and a lower state, wherein the window holder is pivoted upward relative to the base in the upper state and is pivoted downward relative to the base in the lower state.

11. The assembly of claim 1, wherein the window regulator lifter plate assembly includes a first state and a second state, wherein in the first state the base and the window holder are allowed to shift relative to each other, and wherein in the second state the base and the window holder are prevented from shifting relative to each other.

12. The assembly of claim 1, wherein the base and the window holder slide relative to each other during shifting.

13. An adjustable window regulator lifter plate assembly for a vehicle window, the assembly comprising:

a window holder having an inner leg and an outer leg;

a base having an outer side facing the inner leg of the window holder and an inner side;

a fastener extending through a base aperture of the base and into an inner leg aperture of the inner leg of the window holder in a first assembly state;

wherein the inner leg of the window holder includes a curved inner surface, and the outer side of the base includes a curved outer surface corresponding to the curved inner surface of the window holder;

wherein the window holder is shiftable relative to the base in the first assembly state;

wherein the assembly includes a second assembly state, wherein in the second assembly state the fastener is inserted outward relative to the first assembly state and extends into an outer led aperture of the outer leg of the window holder;

wherein the window holder is fixed relative to the base in the second assembly state.

14. The assembly of claim 13, wherein the inner leg aperture of the inner leg is threaded, and the fastener is in threaded engagement with the inner leg in the first assembly state.

15. The assembly of claim 14, further comprising a fastener plate secured to an outer surface of the outer leg of the window holder, the fastener plate including a threaded fastener plate aperture, wherein the fastener is in threaded engagement with the threaded fastener plate aperture of the fastener plate in the second assembly state.

16. The assembly of claim 15, wherein the second assembly state includes an upper state and a lower state, wherein in the upper state the fastener is disposed at an upper end of the base aperture of the base and in the lower state the fastener is disposed at a lower end of the base aperture of the base.

17. The assembly of claim 16, wherein an upper end of the window holder is disposed outwardly in the upper state and inwardly in the lower state.

18. A method for adjusting a window regulator lifter plate assembly for a vehicle window, the method comprising the steps of:

providing a lifter plate assembly in a first assembly state, the lifter plate assembly having an inner side and an outer side and comprising a window holder, a base, and a fastener, wherein the fastener extends through a base aperture in the base and into an inner led aperture formed in an inner leg of the window holder;

inserting the fastener through an outer leg aperture formed in an outer leg of the window holder and, in response thereto, securing the window holder relative to the base in a second assembly state;

wherein the inner leg of the window holder has an inner surface and the base has a corresponding outer surface, such that the window holder shifts relative to the base in the first assembly state and the window holder is fixed relative to the base in the second assembly state.

19. The method of claim 18, further comprising:

accessing an inner end of a cam on the inner side of the assembly, wherein the cam extends through the base and is in contact with the window holder; and rotating the cam and, in response thereto, shifting the window holder relative to the base;

wherein the inner leg of the window holder has a curved inner surface and the base has a corresponding curved outer surface, such that the window holder slides along the base and pivots in response to rotation of the cam.

20. The method of claim 19, wherein the assembly includes a fastener plate secured to the outer leg, and the fastener plate includes a threaded fastener plate aperture and receives the fastener in the second assembly state.

21. The method of claim 19, wherein the second assembly state includes an upper state and a lower state, wherein in the upper state, the fastener is disposed at an upper end of the base aperture in the base and in the lower state the fastener is disposed at a lower end of the base aperture in the base.

22. The method of claim 19, wherein the inner and outer leg of the window holder are monolithically formed.

* * * * *